United States Patent [19]

Holmes

[11] 4,306,499

[45] Dec. 22, 1981

[54] ELECTRIC SAFETY SQUIB

[75] Inventor: Wayne W. Holmes, Brigham City, Utah

[73] Assignee: Thiokol Corporation, Newtown, Pa.

[21] Appl. No.: 109,730

[22] Filed: Jan. 4, 1980

Related U.S. Application Data

[63] Continuation-in-part of Ser. No. 909,143, Jun. 15, 1978, abandoned, which is a continuation-in-part of Ser. No. 892,725, Apr. 3, 1978, abandoned.

[51] Int. Cl.[3] ..... F42C 11/00; F42C 19/06

[52] U.S. Cl. ..... 102/202.4; 102/202.9

[58] Field of Search ..... 102/28 R, 28 S, 28 M

[56] References Cited

U.S. PATENT DOCUMENTS

| | | | |
|---|---|---|---|
| 2,173,270 | 9/1939 | Burrows | 102/28 M |
| 2,801,585 | 8/1957 | Smith | 102/28 M |
| 2,920,569 | 1/1960 | Menke et al. | 102/28 M X |
| 2,960,932 | 11/1960 | Scherrer | 102/28 M |
| 3,264,989 | 8/1966 | Rucker | 102/28 R |
| 3,572,247 | 3/1971 | Warshall | 102/28 R |
| 3,971,320 | 7/1976 | Lee | 102/28 R |
| 4,061,088 | 12/1977 | Ueda | 102/28 R |

FOREIGN PATENT DOCUMENTS

| | | | |
|---|---|---|---|
| 811159 | 4/1959 | United Kingdom | 102/28 R |
| 1017516 | 1/1966 | United Kingdom . | |
| 1251080 | 10/1971 | United Kingdom . | |

*Primary Examiner*—David H. Brown

*Attorney, Agent, or Firm*—Gerald K. White

[57] ABSTRACT

An electric safety squib having a grounded outer case and a pair of normally ungrounded terminals includes a closed thermally and electrically conductive container filled with pyrotechnic material. An electrical resistance wire is embedded in the pyrotechnic material for controlled ignition thereof. A separate conductor extends from each of the terminals to an associated end of the resistance wire through a resistive header and a chamber holding ferrite beads whereby energy of radio-frequency and electrostatic origin extraneously induced in the terminals and conductors is dissipated into the bulk of the conductors, the resistive header and ferrite beads. The arrangement features the disposition of the ferrite beads in good heat transfer relation with the chamber walls whereby heat is carried away from the ferrite beads to limit any rise in temperature thereof, and further features the connection of the junction of one of the conductors and the resistance wire directly to the container wall, and the spacing of the container wall with respect to the outer case to provide a measured spark gap therebetween whereby radio-frequency and electrostatic energy above a threshold value that may reach the resistance wire is conducted by the walls of the container around and away from the pyrotechnic material and is discharged through the spark gap, thereby preventing such energy from passing through the pyrotechnic charge and developing enough concentrated heat to ignite it.

36 Claims, 4 Drawing Figures

ELECTRIC SAFETY SQUIB

This application is a Continuation-in-Part of application Ser. No. 909,143, now abandoned, filed June 15, 1978, which application, in turn, is a Continuation-in-Part of application Ser. No. 892,725, filed Apr. 3, 1978, now abandoned.

BACKGROUND OF THE INVENTION

1. Field of the Invention

This invention relates to ignition devices, and more specifically, to electric safety squibs that are insensitive to, and hence, are incapable of being fired by extraneous radio-frequency signals or electric field effects of ordinary intensity that normally pervade the environment.

2. Description of the Prior Art

Electric squibs have long been widely used for many purposes including the firing of explosives for mining, quarrying, demolition, and highway blasting, and for igniting ordnance devices such as flares, explosives, and rockets. A more recent use of electric squibs is for firing inflators for safety air bags in automotive vehicles, combustible gas generants enclosed in a pressure vessel having emerged as a favored means for inflating passive restraints.

Typically, the energizing terminals of electric squibs are connected by parallel rod conductors to the interior of a container or cup containing a pyrotechnic material. In another form, a coaxial type, one of the conductors is tubular in form and the other conductor is a rod centrally positioned therein. The ends of the conductors in the container, in both types of electric squibs, are joined together by a resistance wire or bridge that is designed rapidly to heat the pyrotechnic material to its ignition temperature when energized with sufficient electrical current.

A long standing problem with electric squibs is that their energizing terminals tend to function as antennas that pick up extraneous radio-frequency and electrostatic energy. Radar signals are of particular concern because of their tendency to form transitory peaks of high intensity that are capable of firing the squib. Such firing is caused either by heating the pyrotechnic material of the squib to its flame temperature, by way of contiguous, metallic parts, or by corona discharge or sparking into the pyrotechnic material.

A solution to the problem proposed in the prior art has been twofold. First, there has been disposed between the conductors of the squib, en route to the resistance wire, devices such as ferrite beads, disc capacitors, and resistance headers. These devices are provided to attenuate extraneous radio-frequency electrical energy, in a manner analogous to eddy current dissipation, thereby to diminish it in magnitude prior to reaching the resistance wire and pyrotechnic material. Additionally, one of the conductors is electrically connected to the outer conductive housing or case that is provided for the squib, and the housing is grounded to portions of the device in which the squib is installed. This connection passes off to ground, through a path other than the pyrotechnic material, electrostatic potentials that tend to build up on the resistance wire.

While such an arrangement is satisfactory for many uses of electric squibs, it is not permissible for others. In particular, this solution is unacceptable when the squib is used to fire the inflator for a safety air bag in an automobile, as is disclosed, for example, in U.S. Pat. No. 3,985,076 issued on Oct. 12, 1976, Fred E. Schneiter et al, and assigned to the assignee of the present invention. Specifically, as proposed in the prior art, ferrite beads, disc capacitors and resistance headers have been found ineffective to reduce to an acceptable low level radio frequency energy that reaches the resistance wire and pyrotechnic material. The effectiveness of ferrite beads in attenuating radio-frequency energy has been found to diminish appreciably in the presence of sustained bursts of radio-frequency energy. Such dimunition in attenuating capacity is due to a tendency for the temperature of the beads to rise as a result of the heat generated therein as they dissipate the radio-frequency energy. The rise in temperature has been found to be so great as to appreciably reduce the paramagnetic characteristic of the ferrite beads, and hence, their capacity for attenuating radio-frequency energy.

Additionally, a permanent connection to ground of one of the squib conductors or terminals, as proposed in the prior art, would interfere with the diagnostic or monitoring circuitry required for automobile safety air bag applications, to which circuitry the squib necessarily is connected. The diagnostic circuitry is provided to check for proper operation of the impact sensors and the circuitry associated therewith each time the automobile is started, and a permanent ground connection of a squib terminal would give a false indication of proper operation in the presence, for example, of a short in the cable harness.

SUMMARY OF THE INVENTION

Among the objects of the invention is to provide in an electric squib electric and heat shield means for the pyrotechnic charge whereby electrostatic and heat energy above safe threshold values tending to be developed on the pyrotechnic charge are dissipated and conducted away and disposed of through paths that shunt the pyrotechnic charge.

A further object of the invention is to provide in such an electric squib improved means for attenuating radio-frequency signals that tend to be induced in its energizing conductors.

Another object of the invention is to provide in such an electric squib an electrically conductive shield that surrounds the pyrotechnic charge and includes a spark gap connection to ground such that electrostatic potentials above a threshold value tending to be developed on the pyrotechnic charge are dissipated by arcing across the spark gap.

A specific object of the invention is to provide an electric squib for firing air bag inflators for automotive vehicles that is incapable of accidental firing by radar installations and other sources of extraneous radio-frequency and electrostatic energy.

A more specific object of the invention is to provide such an electric squib for automotive vehicle air bag inflators in which extraneously induced radio-frequency and electrostatic energy are rendered ineffective to fire the squib by attenuation and arcing in a manner that does not interfere with the impact-sensing diagnostic or monitoring circuits that are provided in association with the air bag inflators.

In accomplishing these and other objects of the invention there is provided an electric squib having a pair of electrical conductors that are connected together at one end by a resistance, bridge wire. The conductors pass, in succession, from a pair of input terminals through a resistance header, two ferrite beads disposed in tandem, and the wall of an electrical and heat conductive container or cup that is filled with a pyrotechnic material and in which the resistance, bridge wire is embedded. One of the conductors is electrically connected to the container, or to a metal foil lining provided therein if the container is made of plastic, and the other conductor is electrically insulated therefrom. The resistance wire ignites the pyrotechnic material when electric current of sufficient magnitude flows through it.

The squib further includes an electrically conductive outer housing or case that is arranged in good thermal conducting relation with the resistance header and ferrite beads for facilitating the transfer thereto of heat from the resistance header and ferrite beads thereby to reduce the tendency for the resistance header and ferrite beads to rise in temperature in the presence of extraneous radio frequency signals. To that end, the outer housing desirably is provided with a relatively massive annular flange for mounting of the squib to the inflator or other device to be fired, the latter further comprising a heat sink into which heat can flow, thereby minimizing any tendency for the resistance header and ferrite beads to rise in temperature above a desirably low level at which the ferrite beads have maximum effectiveness in attenuating radio frequency energy.

Further, in accordance with the invention, the outer housing or case is spaced from the electrically conductive container and the conductors by an electrically insulating sleeve. The arrangement of and spacing between the container and outer housing is such as to provide an easy path for conducting electrostatic electricity and heat around and away from the pyrotechnic charge. Specifically, electrostatic charge above a predetermined threshold intensity or value that tends to build up on the pyrotechnic charge is allowed to arc from the container or metal foil lining therein to the grounded housing. The electrostatic charge is thus rendered incapable of igniting the pyrotechnic charge.

BRIEF DESCRIPTION OF THE DRAWINGS

In the following detailed description of the invention, reference is made to the accompanying drawings which form a part hereof. Like numerals refer to like parts in all views of the drawings and throughout the description. In the drawings.

DESCRIPTION OF THE PREFERRED EMBODIMENTS

Figure 1:
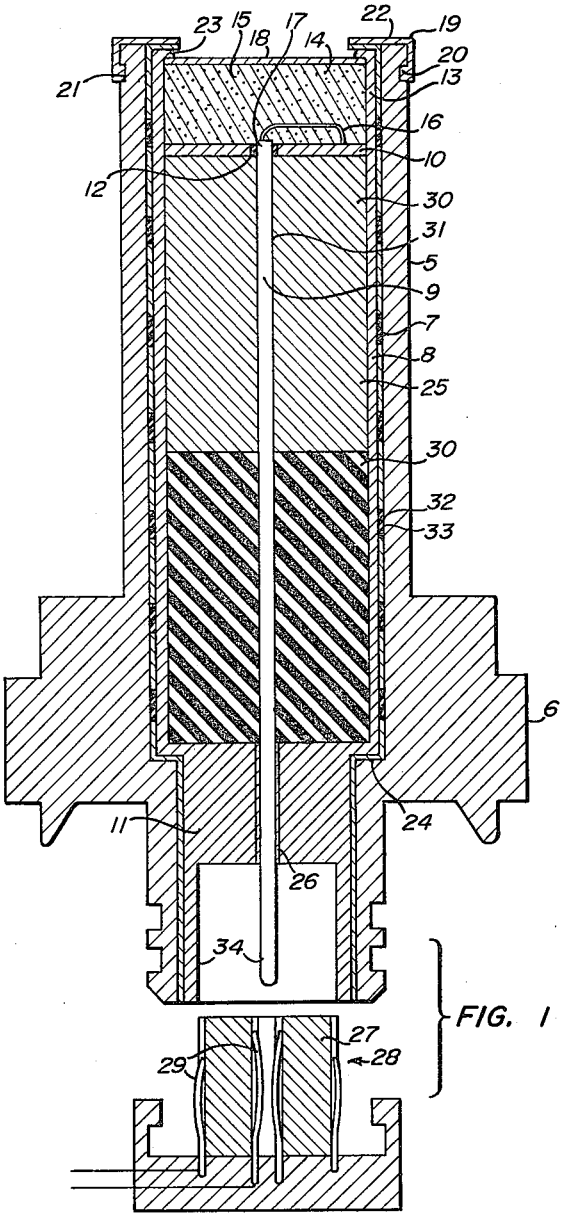
FIG. 1 is a longitudinal section illustrating an embodiment of the electric squib, a coaxial type, according to the invention.

The electric squib of the FIG. 1 embodiment of the invention includes an electrically conductive tubular igniter body or housing 5 having an annular flange 6 for mounting it to other devices that are to be fired or ignited. Flange 6 is relatively massive, as shown, and is selected to have good heat conductivity, the inflator or other device in which the flange 6 is mounted desirably serving as a heat sink therefor. An electrically insulating sleeve 7 fits inside the housing 5 and a tubular electrical conductor 8 of good heat conductivity fits inside the sleeve 7. The thickness of the sleeve 7 and the spacing between the conductor 8 and the housing 5 are carefully calculated to provide a spark gap from the conductor 8 to the housing 5 for energy above a given, threshold intensity.

A second conductor 9 has the form of a rod and is centrally positioned in the housing 5 by first and second partitions, 10 and 11, respectively. The first partition 10 is relatively thin, is electrically conductive, has good heat conductivity, and is press-fitted into the tubular conductor 8. Partition 10 is insulated from the rod conductor 9 by an insulating ferrule 12 that fits over the rod 9. With one end portion 13 of the tubular conductor 8, the partition 10 forms a first chamber or cup 14 for containing a pyrotechnic composition or material 15. A small bridge or resistance wire 16 is embedded in the pyrotechnic material 15 and is connected at one end thereof to the end portion 17 of the rod conductor 9 that extends through the first partition 10. The other end of resistance wire 16 is connected electrically to the partition 10. This provides for grounding of the resistance wire 16 by the above-mentioned spark gap, as further described herein, so that extraneous electrical, radio-frequency or electrostatic energy cannot produce corona discharges therefrom and will not arc through the pyrotechnic material 15.

The first chamber 14 is closed by an electrically-conductive plate 18 or end cap that has good heat conductivity and is retained in the tubular conductor 8 by crimping the outer edge thereof. Hence, the pyrotechnic material 15 is completely surrounded by walls that are good heat and electrical conductors, so that heat and any extraneous static electricity above a predetermined threshold value tending to be developed on resistance wire 16 will be conducted away through the walls of the first chamber 14, rather than through the pyrotechnic material 15.

A retaining ring 19 has a short, inner flange 20 that extends inwardly and fits into an annular groove 21 in the end portion of the housing 5. An outer flange 22 on the retaining ring 19 also extends inwardly and over the end of the housing 5 to help retain the sleeve 7 and the first conductor 8 therein. The outer flange 22 of the retaining ring 19 is separated and spaced from the end of the tubular conductor 8 by an inwardly-extending flange 23 of the sleeve 7, so that it creates a spark gap from the tubular conductor 8 to the retaining ring 19. The flange 22 of the retaining ring 19, together with an annular shoulder 24 in the housing 5, the sleeve 7, and the tubular conductor 8, provide stop means for retaining the sleeve 7 and conductor 8 in the housing 5.

A second chamber 25 is created in the tubular conductor 8 by the second partition 11. This partition 11 may be either of the material of the tubular conductor 8, and perhaps integral therewith, as shown in FIG. 1, or it may be made of electrically resistive material having a resistance of at least 10,000 ohms between the conductors. If the partition 11 is made of material having good electrical conductivity, it is insulated from the second, or rod conductor 9 by an insulating tube 26. In this case, a resistive header 27 is incorporated into an electrical connector 28, in contact with and having a resistance of at least 10,000 ohms between the electrical conductors 29 thereof. If made of resistive material having a resistance of at least 10,000 ohms between conductors 8 and 9, the second partition 11 will function as an attenuating device for extraneous electrical pulses of energy that could otherwise be powerful enough to fire the squib. This is especially true for extraneous energy at the upper end of the frequency spectrum, for which inductance of the conductors and resistance wire becomes significant.

Two ferrite beads 30 fill the second chamber 25, the rod conductor 9 passing through aligned central holes 31 therethrough, and being suitably electrically insulated therefrom. These ferrite beads 30 function to attenuate, that is, dissipate therein, high or radio frequency electric signals that may be picked up by the conductors 8 and 9.

The conductors 8 and 9 are typically made of copper, brass, or bronze; the insulating sleeve 7 is preferably an injection-molded dielectric; the housing 5 is made of steel; and the pyrotechnic material is typically a mixture of potassium perchlorate and zirconium or titanium. The resistive header 27 and the ferrite beads 30 are of commercially available metallic oxides or metallic particles embedded in a plastic matrix.

In another embodiment, the sleeve 7 is provided with numerous perforations 32 that are filled with silicone grease 33 to effect a better transfer of heat from the ferrite beads 30 and the tubular conductor 8 to the housing 5 (see FIG. 1, the right-hand side), flange 6 and the heat sink provided by the device to be fired in which the electric squib is installed. Such better transfer of heat from the ferrite beads to the housing 5 and to a heat sink, as described, is effective to limit any rise in temperature of the ferrite beads resulting from the presence of radio frequency signals or other effects to a level below that at which the ferrite beads lose their paramagnetism, and hence, their capacity for attenuating radio frequency signals. The Curie point of ferrites is quite low, being in the range of 100°–300° C. (see page 4–114 of the Standard Handbook for Electrical Engineers, Donald G. Fink and H. Wayne Beaty, McGraw-Hill Book Company, New York [1978]). When heated to the Curie point, ferrites lose the characteristic properties and cease to be magnetic (see page 201, Encyclopaedia Britannica, Volume 9, Encyclopaedia Britannica, Inc., William Benton Publisher, Chicago [1969]).

The typical radio-frequency noise or extraneous signals that are the primary concern of this invention are characterized by high frequencies (10,000 Hz to 100,000,000 Hz, for example) and high voltages, but much lower amperages than that of the direct-current signal intended to energize and operate the squib. Such extraneous energy can be induced into the terminals 34 of the conductors 8 and 9, functioning as antennas. Generally, all but the most intense of this extraneous energy will be dissipated, first by the resistive header 27, and then by the ferrite beads 30, heat generated in the latter being conducted away to a heat sink, as described above. Any such energy that is not so dissipated or diminished and that reaches the resistance wire 16 will be conducted thereby into the tubular conductor 8. If the extraneous energy still has an electrical intensity above a predetermined threshold intensity, it arcs into the bulk of the housing 5, externally of cup 14 that contains the pyrotechnic material 15, across the spark gap from the end cap 18 to the retaining ring flange 22. Another possible spark gap is provided at the terminal end of the squib from the tubular conductor 8 to the housing 5.

Figure 2:
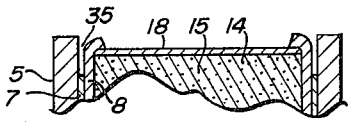
FIG. 2 is a fragmentary view similar to FIG. 1, but showing a modification thereof.

FIG. 2 shows a modification of the electric squib embodiment of FIG. 1 which eliminates the retaining ring 19 and the groove 21. This is possible if the tubular conductor 8 and the sleeve 7 are either press-fitted into the housing 5 or bonded therein. In this embodiment, the insulating sleeve 7 is made somewhat shorter than the tubular conductor 8 and the housing 5 thereby to provide an air gap 35 therebetween for sparking of extraneous electrical energy.

Figure 4:
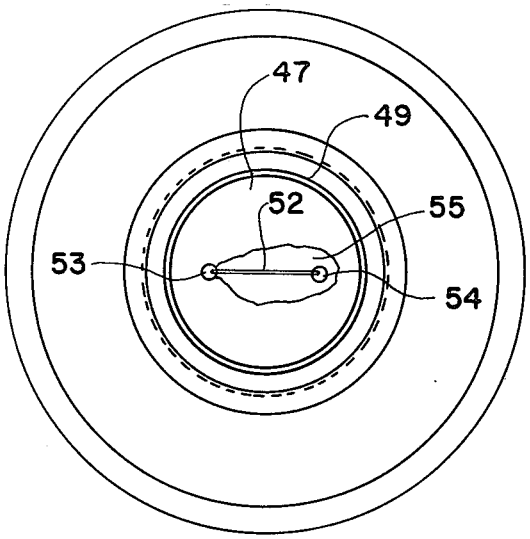
Figure 3:
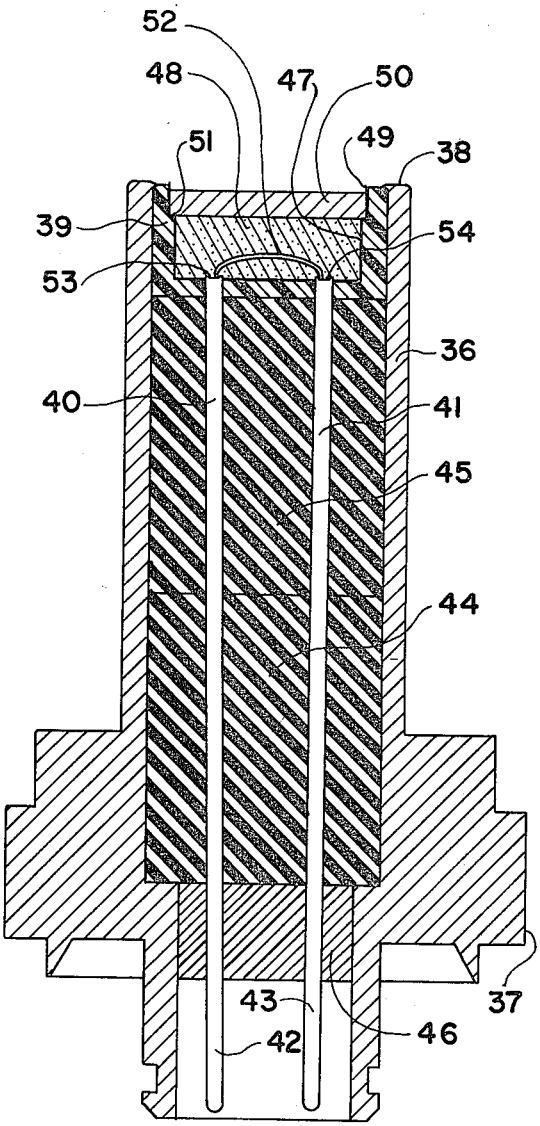
FIG. 3 is a longitudinal section of another embodiment of the electric squib, a parallel rod type, according to the invention; and, FIG. 4 is a top view of the electric squib of FIG. 3 with portions removed.

The parallel conductor rod electric squib embodiment of the invention illustrated in FIGS. 3 and 4 includes an outer tubular metal housing or case 36 that is made of steel, for example, and is characterized by having good electrical and heat conducting properties. Tubular housing 36, as shown, includes a relatively massive annular flange 37 having good heat conductivity for mounting the squib on other devices that are to be fired or ignited. The housing 36 and flange 37 may be similar to the housing 5 and flange 6 of the FIG. 1 embodiment. The housing 36, however, includes a crimp indicated at 38 for retaining therein an electrically non-conductive plastic charge cup 39, two parallel conductor rods 40 and 41 having terminal connector pins 42 and 43, respectively, and two ferrite beads 44 and 45 that are positioned in the housing in end-to-end relation. The circumferential walls of ferrite beads 44 and 45, as shown, are in direct physical contact with the inner cylindrical wall of housing 36 thereby to provide better transfer of heat from the ferrite beads 44 and 45 to the housing 36, flange 37, and the heat sink provided by the device in which the squib is installed. For further improving such transfer of heat, voids between the wall of housing 36 and the walls of beads 44 and 45 may be filled by a silicone grease or by a thermally conducting epoxy, the latter when used, serving also to hold the beads firmly in place.

Conductor rods 40 and 41 pass through a resistive header 46, in contact therewith, and through aligned electrically insulated holes in the ferrite beads 44 and 45 into the charge cup 39. Alternatively, conductors 40 and 41 may be provided with suitable electrical insulation. The header 46 is made of a resistive material having a resistance of at least 10,000 ohms between the housing 36 and each of the conductor rods 40 and 41. A suitable electrical connector, not shown, may be provided to connect the terminal connector pins 42 and 43 to a firing circuit, the terminals of which normally are insulated from ground potential so as to avoid interference with diagnostic or monitoring circuitry, as described hereinbefore. Alternatively, the connector pins 42 and 43 may be directly connected to such circuit.

In accordance with this embodiment of the invention, the bottom and side walls of the plastic charge cup 39 are lined with a metal foil lining 47, the metal being one such as copper, brass or bronze and providing good electrical and heat conductivity. A charge of pyrotechnic material 48 is contained in the cup 39, being retained and protected therein, with an edge 49 of the metal foil lining 47 exposed to the exterior of the cup, by a protective closure or cover 50 that rests on a shoulder 51 adjacent the open end of cup 39. Cover 50 is held in position by a suitable means such as press fitting or by an adhesive material. In one form of the FIG. 3 embodiment of the invention, cover 50 may comprise an electrically conductive plate; in another form the cover 50 may comprise a non-conductive plate.

A resistance wire or bridge 52 is embedded in the pyrotechnic charge 48, one end of the wire being connected to an end portion 53 of conductor 40 and the other end connected to an end portion 54 of conductor 41. As illustrated in FIG. 4, which is a top view of the electric squib of FIG. 3 with the protective cover 50 and charge 48 removed, the conductor portion 53 is directly electrically connected to the metal foil lining 47 in charge cup 39. The conductor end portion 54, however, is insulated from the metal foil lining 47. To that end, a small portion of the metal foil lining 47, as indicated at 55, is cut away from around the conductor end portion 54. It will be understood that, if desired, an insulating ferrule, such as the insulating ferrule of the FIG. 1 embodiment, may be placed over the end portion 54 of conductor 41 for providing further electrical insulation of the latter from the metal foil lining 47.

By this arrangement, one end of resistance wire 52 is directly electrically connected to the metal foil lining 47 and the other end thereof is insulated from the lining. Additionally, when the protective closure or cover 50 is made of electrically conductive material, the pyrotechnic charge 48 is completely surrounded by metallic walls providing good electrical and heat conductivity, except for the small cutaway portion of the metal foil lining 47 required for electrically insulating the conductor end portion 54 from the lining 47. When the cover 50 is made of electrically non-conductive material, the sides and bottom only are so surrounded.

In accordance with both forms of this embodiment of the invention, the crimp 38 at the end of the outer housing 36 is so spaced from the edge 49 of the metal foil lining 47 as to provide a carefully measured spark gap between the edge 49 and the housing 36, the latter being grounded to the device upon or in which the electric squib is mounted.

With this arrangement, as in the embodiment of FIG. 1, all but the most intense of extraneous electrical energy induced in the normally ungrounded terminals 42 and 43 will be dissipated, first by the resistive header 46, and then by the ferrite beads 44 and 45, heating of the latter being limited to an acceptably low level by the better heat transfer provided between the beads 44 and 45 and the tubular housing 36. More intense electrostatic energy and heat produced thereby that may reach the resistance wire 52 will be conducted by metal foil lining 47 around and away from the pyrotechnic charge 48. If above a threshold intensity or value, the electrostatic energy will arc across the wall of charge cup 39 to the grounded metal housing 36 through a path independent of the pyrotechnic charge 48. This result is obtained even when the protective cover 50 is made of non-conductive material. The use of a metal, and hence, electrically conductive material, is preferred for the protective cover, however, because of the better heat conduction provided, as well as the complete electrical shielding so obtained. In this way, extraneous electrical radio-frequency signals and electrostatic voltages are prevented from reaching and passing through the pyrotechnic charge 48 and from developing enough concentrated heat to ignite it.

Thus, there has been provided, in accordance with the invention, an advance in the art of electric squibs wherein electrical conductors leading from the squib terminals are connected together at one end by a resistance, bridge wire. The conductors pass through a resistance header, ferrite beads disposed in tandem, and the wall of a container having good thermal and electrical conductivity that is filled with pyrotechnic material, the resistance wire being embedded in the pyrotechnic material. One end of the resistance wire is directly electrically connected to the container and the other is electrically insulated therefrom. The squib further includes a grounded electrically and thermally conductive outer housing or case that is provided with a good conductive connection to a heat sink, the ferrite beads being contained in the housing, in good heat contact therewith. The housing is spaced from the container by an insulating member, the arrangement being such as to provide a path of good heat and electrical conductivity independent of the pyrotechnic charge for conducting heat and electrostatic energy around and away from the pyrotechnic charge. Thus, electrostatic charges that tend to develop on the resistance, bridge wire are allowed to arc harmlessly from the container to the grounded housing and are rendered incapable of igniting the pyrotechnic charge. Significantly, this desirable result is obtained in each of the embodiments of the invention that are illustrated and described while providing but a momentary connection to ground of one of the normally ungrounded squib terminals or conductors, as upon the occurrence of an arc discharge, as described. Such momentary ground connection does not interfere with the proper operation of necessary diagnostic circuitry which may be associated with the electric squib, as when the latter is used for firing the inflator for a safety air bag in an automobile.

For best results in attenuating radio frequency signals, the use of ferrite beads 30 (FIGS. 1 and 2) and 44, 45 (FIGS. 3 and 4) having a high Curie point temperature, 300° C., for example, has been found to be preferable notwithstanding that it is known that ferrite beads having low Curie point temperatures are more effective in attenuating radio-frequency signals. This is because of the tendency for the ferrite beads to generate heat and rise in temperature when attenuating radio-frequency signals. To the extent that a greater temperature rise may be tolerated before the Curie point is reached, the requirement with respect to the rate at which heat is transferred from the ferrite beads to the associated outer housing is relaxed, thus assuring greater reliability in preventing radio-frequency energy from reaching the associated resistance wire and the pyrotechnic material.

Although the preferred embodiments of the invention have been described in specific details, it should be understood that many details may be altered without departing from the scope of the invention, as it is defined in the following claims.

What is claimed is:

1. An electric squib comprising a pyrotechnic charge, electrical means for igniting said pyrotechnic charge, said electrical means having a pair of terminals that normally are insulated from ground potential, and shield means for shielding said pyrotechnic charge from electrostatic energy tending to be induced in said terminals comprising electrically and thermally conductive walls surrounding said pyrotechnic charge in close physical and thermal contact therewith, one terminal of said electrical means being connected to and the other terminal thereof being insulated from said walls whereby electrostatic energy developed on said electric means is conducted around and away from said pyrotechnic charge by said walls, said shield means further including spark gap defining means between said walls and ground potential whereby electrostatic energy on said walls above a threshold value is discharged to ground by arcing.

2. An electric squib as specified in claim 1 wherein said electrical means includes a resistance wire embedded in said pyrotechnic charge.

3. An electric squib as specified in claim 1 including an electrically conductive outer housing, said housing being adapted to provide a ground potential, said shield means being electrically insulated from said housing, and said spark gap being provided between said walls and said housing.

4. An electric squib as specified in claim 3 wherein said housing is elongated, said pyrotechnic charge, electrical igniting means, and said shield means are positioned at one end thereof, and said terminals include electrical conductors that extend exteriorly of said housing at the other end thereof.

5. An electric squib as specified in claim 4 wherein said conductors are disposed parallel to each other in said housing.

6. An electric squib as specified in claim 4 wherein said housing is tubular in form, includes a relatively massive mounting flange, and includes an inner portion that is tubular and concentrically disposed with respect to said housing, and further including at least one ferrite bead that is magnetically associated with said electrical conductors, said ferrite bead being disposed in said inner tubular portion of said housing in good heat transfer relation therewith.

7. An electric squib as specified in claim 4 further including at least one ferrite bead in said housing through which said electrical conductors extend.

8. An electric squib as specified in claim 4 wherein said electrical conductors comprise rods that are disposed parallel to each other in said housing.

9. An electric squib as specified in claim 8 wherein said pyrotechnic charge and electrical means are contained within a plastic cup having an open end and the internal walls of which are provided with a metal foil lining having good thermal and electrical conductivity, said lining comprising said shield means and having an opening through which one of said conductor rods extends, being electrically insulated therefrom, the other of said conductor rods being electrically connected to said lining, and a protective cover for closing the open end of said cup, an edge of said lining being exposed to the exterior of said cup at said one end of said housing by said protective cover thereby to provide said spark gap.

10. An electric squib as specified in claim 8 further including at least one ferrite bead in said housing through which said conductor rods extend.

11. An electric squib as specified in claim 10 including at least two ferrite beads in said housing through which said conductor rods extend, said beads being so disposed in said housing as to be in good heat conducting relation therewith for facilitating the transfer of heat from said ferrite bead to said housing.

12. An electric squib as specified in claim 4 wherein said housing is tubular in form, said wall means of said shield means includes a portion that is tubular and is concentrically disposed with respect to said housing, and an extension of said tubular portion comprises one of said conductors, the other conductor comprising a rod that is centrally positioned with respect to said tubular extension.

13. An electric squib as specified in claim 12 including a dielectric sleeve interposed between said housing and each of said tubular portion and extension.

14. The electric squib of claim 13 wherein said dielectric sleeve is made of synthetic rubber.

15. The electric squib of claim 13 wherein said dielectric sleeve has numerous perforations, and further including a silicone grease filling the perforations to promote heat transfer from said tubular electrical conductor portion and extension to said housing.

16. An electric squib as specified in claim 13 wherein said shield means includes an electrically conductive partition connected to said tubular portion and having an opening through which said conductor rod extends, said conductor rod being insulated from said partition.

17. An electric squib as specified in claim 16 wherein said conductive partition and a second partition in said tubular extension form a chamber, said chamber including at least one ferrite bead having a central hole through which said conductor rod extends.

18. An electric squib as specified in claim 17 further including a connector receptacle on the other side of said second partition and a connector that fits into said connector receptacle and receives the terminal end of said conductor rod, said connector including good electrically conductive connections for contact with the tubular and rod conductors supported on a cylinder of material that has an electrical resistance of at least 10,000 ohms.

19. An electric squib as specified in claim 13 including an electrically conductive end cap retaining in the end of said tubular portion for confining said pyrotechnic charge therein.

20. An electric squib as specified in claim 19 wherein said dielectric sleeve adjacent said end cap is shorter than said housing and said tubular portion of said sleeve means whereby an air gap for sparking is provided between said housing and said tubular portion.

21. An electric squib as specified in claim 19 further including a retaining ring having an inner flange that extends inwardly and fits into a groove in the end portion of said housing adjacent said pyrotechnic charge, and an outer flange that extends inwardly to retain said dielectric sleeve and tubular portion and extension in said housing, and further including an inwardly extending flange on the end of said dielectric sleeve to space the outer flange of the retaining ring from the end of said tubular portion.

22. An electric squib as specified in claim 21 further including mounting means fixed to said housing.

23. An electric squib as specified in claim 22 wherein said mounting means is an annular flange integral with the housing.

24. An electric squib for igniting an automobile air bag inflator, comprising:

an electrically conductive, tubular, outer housing;

a dielectric sleeve that fits inside the housing;

a tubular electrical conductor that fits inside the sleeve and is spaced thereby from the housing a discrete distance calculated to provide spark gaps for extraneous electrical energy of given ranges of voltages and frequencies;

an electrically conductive rod centrally positioned in the housing;

means for retaining the sleeve and tubular conductor in the housing;

a first electrically conductive partition, that fits tightly in the tubular conductor and through which the rod extends, forming a first chamber in one end portion of the tube;

a pyrotechnic material in the first chamber;

means for insulating the rod from the first partition;

a resistance wire attached at one end to the rod in the first chamber and at its other end to the first partition, and passing through the pyrotechnic material;

a second partition that fits tightly in the tubular conductor, forming a second chamber between the first and second partitions and a connector receptacle on the other side of the second partition; and at least one ferrite bead in the second chamber, having a central hole through which the rod conductor passes.

25. The electric squib of claim 24 wherein the sleeve is shorter than the housing and the tubular conductor, so that there is an air gap between the housing and the tubular conductor to provide for sparking.

26. The electric squib of claim 24 further including an electrically conductive end cap retained in the tubular conductor for confining the pyrotechnic material therein.

27. The electric squib of claim 24 further including a retaining ring having an inner flange that extends inwardly and fits into a groove in the end portion of the housing adjacent the pyrotechnic material, and an outer flange that extends inwardly to retain the sleeve and tubular conductor in the housing, and further including an inwardly-extending flange on the end of the sleeve to space the outer flange of the retaining ring from the end of the tubular conductor.

28. The electric squib of claim 24 further including a connector that fits into the connector receptacle and receives the terminal end of the rod conductor, said connector containing highly conductive connections for contact with the tubular and rod conductors supported on a cylinder of material that is conductive above approximately 10,000 ohms.

29. The electric squib of claim 24 wherein the electrically-insulating sleeve is made of synthetic rubber.

30. The electric squib of claim 24 wherein the electrically-insulating sleeve has numerous perforations, and further including a silicone grease filling the perforations to promote heat transfer from the tubular, electrical conductor to the housing.

31. The electric squib of claim 24 further including mounting means fixed to the housing.

32. The electric squib of claim 31 wherein the mounting means is an annular flange integral with the housing.

33. In an electric squib comprising, a pyrotechnic charge, electrical means for igniting said pyrotechnic charge, said electrical means having a pair of terminals, and conventional means for attenuating radio-frequency signals and electrostatic energy that tend to be induced extraneously in said terminals, the improvement comprising providing electrically and thermally conductive walls in close physical and thermal surrounding relation with respect to said pyrotechnic charge, one of said terminals being electrically connected to said walls and the other insulated therefrom whereby electrostatic energy is conducted around and away from said pyrotechnic charge by said walls, and providing a spark gap between said walls and ground potential whereby electrostatic energy above a threshold value will be discharged from said walls to ground by arcing.

34. An electric squib comprising, a pyrotechnic charge, and an electrically conductive grounded housing containing said pyrotechnic charge, electrical means for igniting said pyrotechnic charge, said electrical means having a pair of terminals that normally are insulated from ground potential, and shield means including ferrite bead means associated with said terminals for attenuating radio frequency signals that tend to be induced therein, said ferrite bead means being disposed in good heat transfer relation with said housing, said shield means further including means for shielding said pyrotechnic charge from electrostatic energy tending to be induced in said terminals comprising thermally and electrically conductive walls surrounding said pyrotechnic charge in good heat transfer relation therewith, one terminal of said electrical means being connected to and the other terminal thereof being insulated from said walls whereby electrostatic energy developed on said electric means is conducted around and away from said pyrotechnic charge by said walls, said shield means further including spark gap defining means between said walls and said grounded housing whereby electrostatic energy on said walls above a threshold value is discharged to ground by arcing.

35. An electric squib as specified in claim 34 wherein said housing is tubular and includes an inner chamber having cylindrical walls, which chamber is substantially filled by said ferrite bead means, said shield means further including sleeve means that line the cylindrical walls of said chamber and electrically insulate said ferrite bead means from said cylindrical walls, said sleeve being perforated and filled with silicone grease, to effect better transfer of heat between said bead means and said housing.

36. An electric squib as specified in claim 34 wherein said housing includes an inner chamber having cylindrical walls, in which chamber said ferrite bead means are disposed, said ferrite bead means filling said chamber and having walls that are in direct physical contact with said cylindrical walls of said housing.

* * * * *